US006098897A

United States Patent [19]

Lockwood

[11] Patent Number: 6,098,897

[45] Date of Patent: Aug. 8, 2000

[54] LOW PRESSURE DUAL FLUID ATOMIZER

[76] Inventor: Hanford N. Lockwood, 2222 Alameda De Las Pulgas, San Mateo, Calif. 94403

[21] Appl. No.: 09/468,716

[22] Filed: Dec. 21, 1999

Related U.S. Application Data

[60] Provisional application No. 60/113,640, Dec. 23, 1998.

[51] Int. Cl.[7] ..... B05B 7/04

[52] U.S. Cl. ..... 239/8; 239/427; 239/432; 239/433; 239/500

[58] Field of Search ..... 239/8, 419, 426, 239/427, 427.3, 432, 433, 434, 500, DIG. 13

[56] References Cited

U.S. PATENT DOCUMENTS

| | | | |
|---|---|---|---|
| Re. 34,586 | 4/1994 | Spink et al. . | |
| 1,659,538 | 2/1928 | Angrove | 239/500 X |
| 3,230,923 | 1/1966 | Hughes . | |
| 3,230,924 | 1/1966 | Hughes . | |
| 3,240,253 | 3/1966 | Hughes . | |
| 3,240,254 | 3/1966 | Hughes . | |
| 4,002,297 | 1/1977 | Pillard | 239/432 X |
| 4,356,970 | 11/1982 | Vosper et al. . | |
| 4,362,274 | 12/1982 | Davis . | |
| 4,516,728 | 5/1985 | Whinfrey | 239/433 X |
| 4,726,524 | 2/1988 | Ishikawa et al. | 239/500 X |
| 4,819,878 | 4/1989 | Bailey et al. | 239/433 X |
| 4,893,752 | 1/1990 | Spink et al. . | |
| 4,989,675 | 2/1991 | Papavergos | 239/433 X |
| 5,025,989 | 6/1991 | Spink et al. . | |
| 5,170,942 | 12/1992 | Spink et al. . | |
| 5,176,324 | 1/1993 | Furuse et al. | 239/433 X |
| 5,368,230 | 11/1994 | Oppenberg | 239/433 X |
| 5,553,784 | 9/1996 | Theurer . | |
| 5,829,683 | 11/1998 | Beaudoin et al. | 239/433 X |

*Primary Examiner*—Andres Kashnikow
*Assistant Examiner*—Steven J. Ganey
*Attorney, Agent, or Firm*—Townsend and Townsend and Crew

[57] ABSTRACT

An atomizer for atomizing a liquid has a gas chamber adapted to be connected to a supply of gas and a liquid chamber adapted to be connected to a source of liquid. A mixing tube extends from the gas chamber in a downstream direction, and atomizing gas flows through the tube at subsonic speed. A liquid conduit fluidly connects the liquid chamber with the mixing tube so that liquid from the conduit can be entrained in the gas flow for discharging a mixture of gas and partially atomized liquid from the tube. The mixture then flows through an exit gap to the exterior of the housing. The exit gap has several successive shear steps which contact the mixture as it flows through the gap to thereby substantially fully atomize the liquid as it is being discharged from the atomizer. The atomizer permits variations in the liquid flow rate and therewith variations in the rate at which atomized liquid is discharged from the atomizer by modulating the rate at which the liquid is entrained in the gas streams while maintaining the gas stream flow rate (and pressure) substantially constant.

34 Claims, 7 Drawing Sheets

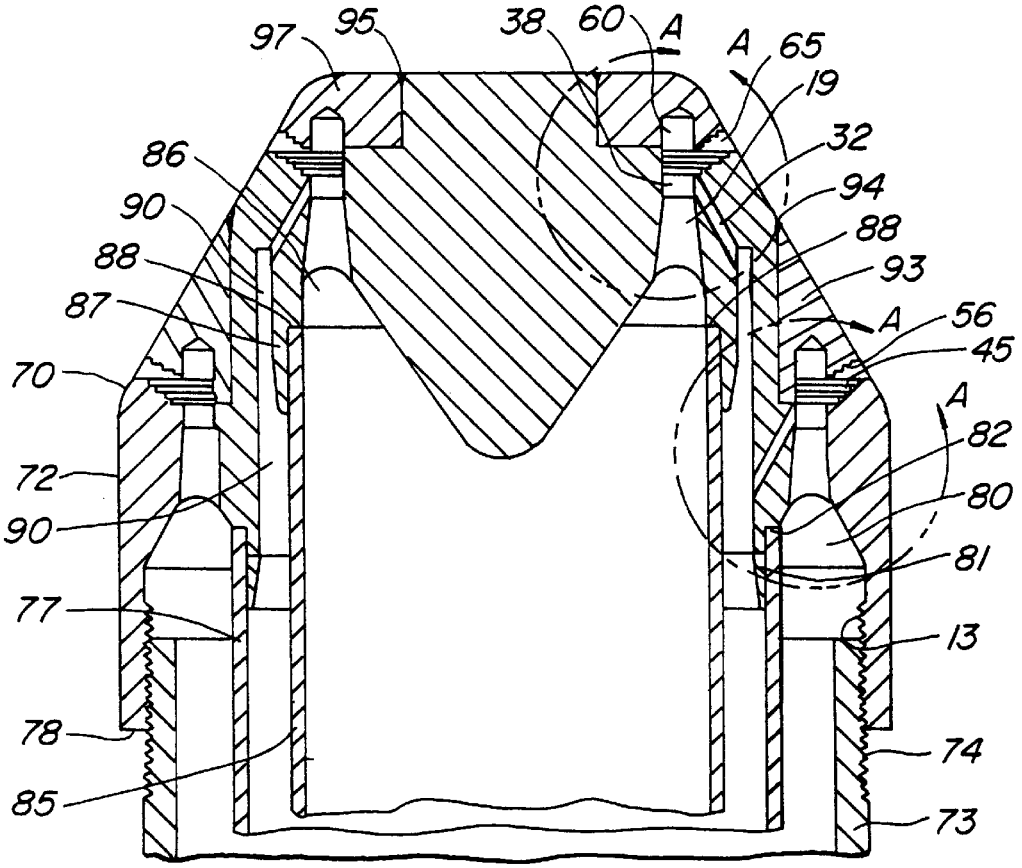
FIG. 5.
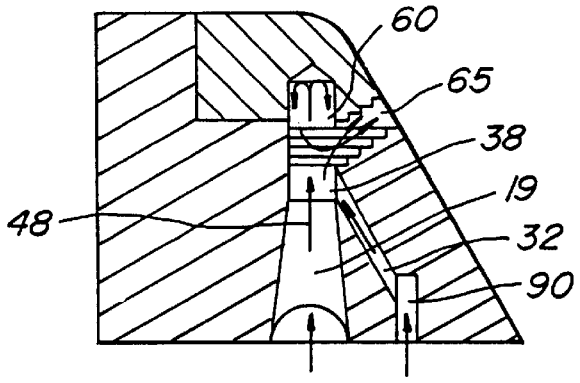
FIG. 6. DETAIL "A"

LOW PRESSURE DUAL FLUID ATOMIZER

This Appln. claims benefit of provisional Appln. 68/113,640 Dec. 23, 1998.

FIELD OF INVENTION

The present invention relates to a dual fluid atomizer which uses a low pressure gas to break up the surface tension in a liquid and produce a finely atomized liquid spray.

DESCRIPTION OF PRIOR ART

There are many industrial applications where a finely atomized liquid is required in a process. Atomized water is used for such processes as evaporative cooling, fire fighting, and even in the manufacture of snow; atomized oil is used in combustion systems; and other liquid chemicals can be atomized to enhance various processes, such as spray drying.

In the past, the atomization of a liquid has been achieved in two ways. The first is by pressure atomization where the liquid is pumped under high pressure through a single fluid nozzle. In such a nozzle, the pressure energy is used to break up the surface tension in the liquid by centrifugal force or by passing the fluid over a shear surface. Sometimes both centrifugal force and shear surfaces are used. Such nozzles use fluid pressures approaching 1000 PSIG, and the atomization achieved is of inconsistent quality. In addition, the turndown ratio of these nozzles—which is the ratio between the maximum nozzle capacity divided by the minimum nozzle capacity in which useful atomization is achieved—is limited to approximately 4:1.

The second method for atomizing a liquid is to augment and enhance the atomization process by mixing a gas with the liquid in a nozzle and use the expansion of the gas as well as a shear surface in the nozzle to achieve the desired atomization. In most dual fluid nozzle designs, the liquid and gas are separately piped to the nozzle tip where they are mixed. The mixed fluids are directed to an exit port where there is a shear surface to help break up the fluid tension in the liquid as the mixture exits the nozzle. The mixture of gas and liquid achieves further atomization as the gas in the mixture expands when it leaves the nozzle exit port.

Such dual fluid nozzles typically use gas and liquid pressures between 100 PSIG and 125 PSIG at full capacity. The gas pressure can be modulated as the liquid pressure is adjusted over the turndown range. As a rule, increasing the gas pressure in relation to the liquid pressure will decrease the liquid flow rate and result in finer atomization, while increasing the liquid pressure in relation to the gas pressure will increase the liquid flow rate and result in coarser atomization. These dual fluid nozzles permit limited turndowns, with the exceptional units achieving turndown ratios of about 8:1.

Many of the dual fluid nozzles used in combustion processes in boilers use steam as the atomizing gas. These atomizers are designed to minimize the volume of gas required to atomize the liquid because the steam used cannot be recovered in the condensate return system. Since the steam is available at boiler pressure, there is no appreciable penalty for the required, relatively high gas pressure.

When steam is not available, dual fluid atomizers have to use compressed air (or other gas) as the atomizing gas. The design philosophy used in air-atomized nozzles has also been to minimize the amount of air (volume) and use the higher pressure (100 PSIG to 125 PSIG). Air compressors required for such nozzles are expensive to purchase and require costly annual maintenance.

A variety of dual fluid atomizer designs are known. For instance, U.S. Pat. Nos. 3,240,253 and 3,240,254 issued to Hughes show several dual fluid atomizers which accelerate the gas to above sonic velocity, and a portion of the gas stream is turned back against the supersonic nozzle forming a pressure wave that enhances atomization of the injected liquid. The patents disclose several options for injecting the liquid into the supersonic gas nozzle and the pressure wave. In U.S. Pat. No. 3,240,253, Hughes teaches that the lowest atomized mean droplet size is achieved at an input air pressure of 99.7 PSIG.

U.S. Pat. No. 4,356,970 issued to Vosper et al. shows designs for dual fluid atomizers which use minimal gas volumes to atomize the liquid. The atomizers are for burners used in boilers which have the objective of using only about one-third of the gas volume used in earlier atomizers, and they employ gas pressures over 100 PSIG.

Another atomizer is disclosed in U.S. Pat. No. 4,362,274 issued to Davis. This atomizer uses a high pressure atomizing gas to simultaneously atomize a conventional high energy liquid fuel and a waste fuel. The atomizer is intended for use in incinerator burners and also requires high gas pressure.

U.S. Pat. Nos. 4,893,752, 5,025,989, 5,170,942 and Re. 34,586 issued to Spink et al. describe several dual fluid atomizers. All of them use high pressure gas (100 PSIG to 125 PSIG) to atomize a liquid for various processes. These patents all are for atomizers that mix the atomizing gas in the nozzle tip with a liquid, so that the mixture can exit the nozzle cap in different directions and use the expansion of the gas to atomize the liquid. In all nozzles, the gas pressure is close to the liquid pressure, and the atomizers use relatively lower gas volumes to achieve the desired atomization.

U.S. Pat. No. 5,553,784 issued to Theurer discloses another high pressure dual fluid atomizer. In this atomizer, a liquid and gas enter a mixing chamber where they mix prior to entering a tapered exit port. The exit port has a tapered pintel with an impact plate on the end which at least partially diverts the mixture flow and acts as a shear surface at the nozzle outlet. This atomizer design uses low volume gas at high pressure to atomize the liquid as it exits the nozzle.

Thus, the patents discussed above are for atomizers which attempt to minimize the volume of atomizing gas that is needed and maintain the pressure of the gas close to the pressure of the liquid. In each case, to change the output of the atomizer the atomizing gas pressure and the liquid pressure are modulated over the turndown range. In each case, the atomizers require high pressure air (or other gas) compressors to generate the needed atomizing gas. Producing high pressure gas is expensive, and costs increase with increasing pressures.

In addition, prior art atomizers, particularly those which generate a uniformly fine dispersion of liquid particles or droplets suspended in the air (or other gas), rely primarily on the energy of the high pressure gas to effect atomization of the liquid. When it is time to reduce the rate at which the liquid is atomized, it is necessary to approximately proportionally reduce the air flow and liquid flow rates because, in order to function, the liquid pressure must at all times exceed the gas pressure where the two are mixed. A reduction of the air flow rate, however, immediately and drastically reduces the atomization efficiency. As a result, atomizers using high pressure air as the primary atomizing agent have limited turndown ratios.

Thus, there is a need for a new and practical dual fluid atomizer which does not have the deficiencies described above and which improves performance while reducing operating costs.

SUMMARY OF THE INVENTION

The present invention is a low pressure dual fluid atomizer which uses an atomizing gas pressure of less than about 30 PSIG combined with a relatively larger volume of atomizing gas to provide the energy needed for atomization. As a result of the reduced gas pressure, the generation of the atomizing gas uses less than half the power to compress it as compared to the prior art nozzles even though it uses a relatively larger amount (volume) of gas.

The low pressure dual fluid atomizer of the present invention initially entrains the liquid in the compressed air which flows at subsonic speeds, resulting in only a partial atomization of the liquid in the mixture. To attain fall homogeneous atomization, it employs a resonator to force the mixture back on itself so that atomization is continued by the shear forces created when two opposing streams impact on each other. To continue the atomization of the liquid in the mixture, the mixture passes over and is contacted by a series of successive shear steps prior to exiting the nozzle outlet. Additional atomization results from the expansion of the atomizing gas after it leaves the nozzle outlet.

An advantageous characteristic of the new low pressure dual fluid atomizer is the independence of the atomizing gas and liquid pressures. During normal operation, the nozzle uses a constant atomizing air pressure, preferably set, maintained and fixed at a pressure in the range of about 15 PSIG to 25 PSIG. The liquid pressure, however, can be modulated over a wide range, for example from a high of about 70 PSIG down to a minimum pressure just slightly above the air pressure at the point where the liquid is entrained in the gas flow. This atomizer has been operated and exhibited stable operation over a turndown ratio of up to 50:1 when tested in a horizontal position.

Generally speaking, an atomizer for atomizing a liquid in accordance with the invention has a gas chamber adapted to be connected to a supply of gas and a liquid chamber adapted to be connected to a source of liquid. A mixing tube extends from the gas chamber in a downstream direction and terminates at an outlet. A liquid conduit fluidly connects the liquid chamber with the mixing tube so that liquid from the conduit can be entrained in the gas flow for discharging a mixture of gas and partially atomized liquid from the tube. The mixture then flows through an exit slot or gap to the exterior of the housing. The exit gap has several successive shear steps which contact the mixture as it flows through the gap to thereby substantially fully atomize the liquid as it is being discharged from the atomizer.

The initial mixture discharged from the acceleration tube of the atomizer is further directed towards a resonant cavity that is aligned with the acceleration tube and spaced therefrom by an intervening atomizing chamber which in turn fluidly communicates with the exit gap. The mixture reflected in the resonant cavity turns on itself, so to speak, impacts with additional mixture discharged from the mixing tube, and thereby causes turbulent flow in the atomizing chamber which causes additional atomization of the liquid droplets in the mixture.

The present invention also includes a method for atomizing a liquid while permitting variations in the liquid flow rate and therewith variations in the rate at which atomized liquid is discharged from the atomizer. The method involves forming a plurality of subsonic, separate gas streams which have a substantially constant subsonic flow rate and a substantially constant pressure. The liquid is entrained in each gas stream to form the gas/liquid mixture in which the liquid is only partially atomized. The separate mixture streams are turbulently intermingled in the atomizing chamber, to further atomize the liquid droplets, and the intermingled mixture is then directed to the exterior via the exit gap by contacting the mixture with a plurality of serially arranged shear steps to further atomize the liquid at the time it is discharged. Finally, the rate at which the liquid is entrained in the gas streams is modulated, while the gas stream flow rate and the gas pressure are maintained substantially constant to thereby correspondingly vary the rate at which atomized liquid is discharged from the atomizer.

To maintain low operating costs, primarily by minimizing pressure drops of the pressurized gas as it flows through the atomizer, the mixing tube is constructed in two sections. An upstream section, which communicates the gas chamber, is frustoconical, converges in a downstream direction, and connects to a mixing section of the tube, where the gas flow rate is at a maximum. Liquid from the liquid chamber is entrained in the gas flow through the mixing section of the tube, preferably by flowing the liquid into the mixing section at an oblique angle that does not exceed approximately 35°. Further, there are preferably a multiplicity, i.e. more than two, of acceleration tubes which are arranged side by side and which open into a common atomizing chamber that extends over part or the entire circumference of the housing, and the exit gap for the mixture is circumferentially coextensive with the atomizing chamber.

This arrangement minimizes pressure drops and, therefore, saves power and cost for generating the needed pressurized air.

Even though the pressurized air used in the atomizer of the present invention has a pressure insufficient to fully atomize the liquid when it is first entrained, complete, homogenous atomization is attained because the mixture successively passes through the atomizing chamber, is at least partially reflected in the resonant cavity, is subject to the earlier mentioned turbulence in the atomizing chamber, and then flows over the shear steps in the exit gap to the exterior of the housing. In the process, the liquid droplets, and especially the larger ones, are subjected to repeated impact and shear, all of which combine to effect a fine and uniform atomization of the liquid. Since the speed (or pressure) of the atomizing air is not the primary cause for the atomization of the liquid, the air pressure can be maintained low. This in turn enables an operation of the atomizer at relatively high or low liquid pressures. The only requirement is that the liquid pressure exceed the air pressure at the point where they are mixed so that the liquid can be injected into the air flow. The atomized liquid output of the atomizer can therefore be reduced by simply reducing the liquid pressure until the desired, lower flow rate is attained. For each specifically set atomizing gas inlet pressure, there is a specific atomizing gas pressure at the exit of the acceleration tube or point of entrainment of the liquid. The atomizing gas pressure at the point of entrainment is typically 5 to 10 PSIG below the atomizing gas inlet gauge pressure. Thus, the atomizer of the invention can be operated with liquid pressures over a range from, say, a high of about 70 PSIG at fall capacity down to just above the air pressure at the point of entrainment at the lowest nozzle capacity. Since the atomizer can be operated with a gas supply pressure as low as 12 PSIG (although typically it will lie in the range of between 15 to 25 PSIG), and the gas pressure at the point of entrainment is a constant base pressure for supplying liquid to the atomizer, the atomizer can use liquid pressures which amount to a very low differential above the base pressure and, therefore, make turndown ratios of up to 50:1 possible.

In contrast, prior art dual fluid atomizers relying on supersonic air speeds and correspondingly high air pressures require a minimum liquid pressure which exceeds the air pressure of 100 PSIG or more. Since air pressures could not be greatly reduced in prior art atomizers without compromising atomization effectiveness, and since it is impractical, difficult and relatively expensive to use excessively high liquid pressures during normal or maximum capacity operation of the atomizer, the prior art dual fluid atomizers had the earlier mentioned limited turndown ratio, a shortcoming that is effectively and inexpensively overcome by the atomizer of the present invention.

In most cases, the low pressure dual fluid atomizer can have a spray pattern over a specific sector such as a 180° arc, or a 90° arc. Because each feed hole for the liquid is directed into a specific feed hole for the atomizing gas, the atomizer directs atomizing gas and liquid to a designated sector only.

The low pressure dual fluid atomizer of the invention can also deliver different conical spray angles for differing applications. The atomizer has one or more discharge slots where the atomized mixture of gas and liquid particles exits from the nozzle. The conical spray pattern typically is a cone with a designed included angle that is bisected by the centerline of the low pressure dual fluid atomizer. The atomizer can have an included cone angle in the range between 30° and 180°.

The atomizer of the invention is preferably made from stainless steel for most applications. It can also be used in an environment where the atomizer can be subjected to chemical attack. In such cases, it can be made from materials such as monel and hastalloy. The special design considerations that make the low pressure dual fluid atomizer perform as designed also make it possible to fabricate the atomizer from exotic materials.

In the event the low pressure dual fluid atomizer is used to atomize a liquid which has suspended solid particles, the atomizer can be fabricated from ceramics which are exceptionally hard and will significantly reduce any wear on the atomizer impact or shear surfaces.

The atomizer is more efficient and has a significantly larger turndown ratio than prior art atomizers. It also overcomes the disadvantages of prior atomizers, and it is versatile, which allows its use to be in a large number of atomizer applications.

BRIEF DESCRIPTION OF THE DRAWINGS

FIG. 5 is a cross-sectional view of the high capacity version of the low pressure dual fluid atomizer;

FIG. 6 is a detail "A" of FIG. 5 which shows the enlarged details of the gas and fluid mixer, the resonator cavity and atomizer discharge system;

DESCRIPTION OF THE PREFERRED EMBODIMENTS

Figure 1:
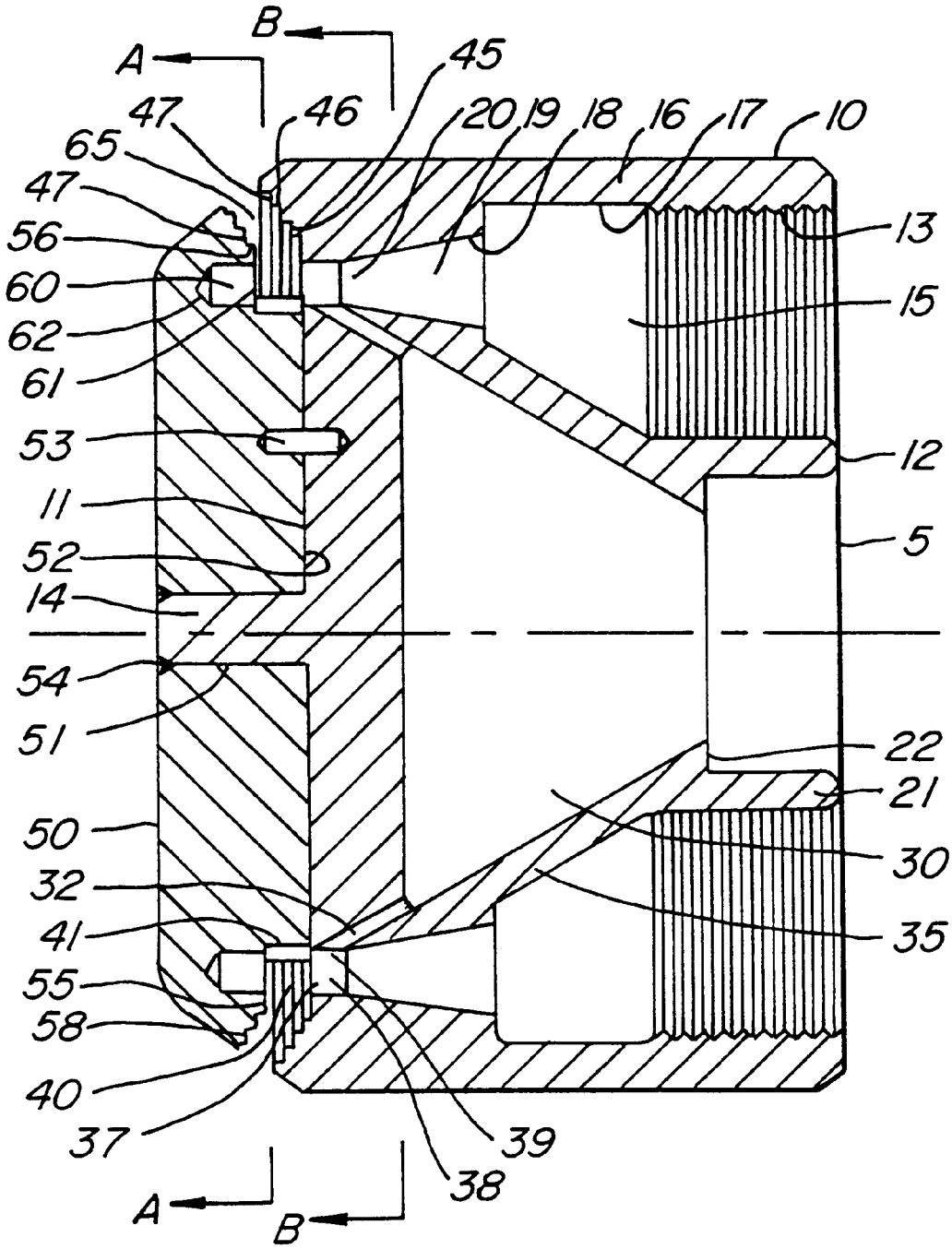
FIG. 1 is a cross-sectional view of the low pressure dual fluid atomizer of the present invention.

Referring to FIGS. 1–4, the low pressure dual fluid atomizer 5 of the invention has an atomizer housing or body 10 with a front face 11 and a back end 12 where pressurized gas and liquid are introduced into the atomizer body 10. A gas supply tube (not shown) is concentric to a liquid supply tube (not shown) and has threads which engage gas tube threads 13 located on an inside surface 17 of an outer wall 16 of a concentric gas chamber 15.

The gas supply pressure to the concentric gas supply chamber 15 is typically between about 12 PSIG and about 25 PSIG. In a presently preferred embodiment, it is between 15 PSIG and 25 PSIG. The atomizing gas flows from the concentric gas chamber into large ends 18 of a multiplicity of conical, downstream converging acceleration tubes 19 where the atomizing gas converts part of its pressure energy into increasing velocity prior to exiting the acceleration tubes at small ends 20 thereof and entering contingent, constant diameter mixing tubes 38. At the end of acceleration tube 19, the atomizing gas has attained a velocity which is just below the speed of sound for the particular atomizing gas being used. The low pressure dual fluid atomizer 5 is designed so that the atomizing gas does not exceed the speed of sound, i.e. the gas flow is subsonic at all times, in order to keep the atomizing gas pressure as low as possible and save power.

Liquid to be atomized is entrained in the atomizing gas exiting in mixing tube 38 where the two form a mixture of gas and non-uniform liquid droplets. The liquid to be atomized enters the back end 12 of atomizer body 10 through a liquid supply tube (not shown) which is arranged at the center of the gas supply tube (not shown). The liquid supply tube slides inside an inner wall 21 of the concentric gas supply chamber 15. The liquid supply tube end (not shown) forms a liquid-tight seal with a shoulder 22 machined into the inner wall 21 of the concentric gas supply chamber 15. Liquid from the liquid supply tube enters a liquid supply chamber 30 which is aligned with the axis of the housing and is separated from concentric gas supply chamber 15 by a wall 35. Wall 35 prevents a premature mixing of gas and liquid.

Liquid is typically supplied at a pressure of between about 50 PSIG and about 100 PSIG depending on the application of the atomizer system. The liquid supply is normally limited to fluids with a viscosity less than about 400 SSU and can include solids suspended in a colloidal suspension. From the supply chamber 30, the liquid flows and accelerates through a multiplicity of liquid supply ports or conduits 32 into mixing tube 38 located downstream of acceleration tube 19.

One liquid supply port 32 is typically provided for each of the gas acceleration tubes 19. The liquid supply port 32 is positioned at an angle to mixing tube 38 so that the momentum of the liquid entering the mixing tube is almost in the same direction as the atomizing gas stream to reduce pressure losses in the atomizer. The angle between the liquid supply ports 32 and the mixing tube 38 should normally not be greater than 35°. The atomizer becomes more efficient as the angle between the liquid supply ports 32 and the mixing tube 38 becomes smaller, and the minimum angle is normally a function of the geometry and material of the atomizer.

As the liquid and gas mix in mixing tube 38, the energy of the atomizing gas accelerates the liquid stream to an average gas/liquid velocity. The atomizing gas velocity in turn decreases until it reaches the average gas/liquid velocity. In developing a low pressure atomizer in accordance with the invention, the needed gas volume is increased as the gas pressure is decreased to maintain the required momentum in the gas to effectively entrain the liquid in the gas and ultimately achieve the desired atomization. The mass of the atomizing gas is typically approximately one-fifth of the mass of the liquid to be atomized at fall capacity. Thus, with the present invention, gas/liquid mixtures have a mass (comprising air and water) of no more than about 3 lbs/cuft and typically it will be as low as 1.11 lbs/cuft at the nozzle inlet. Prior art atomizers using high atomizing gas pressures use atomizing gas which is approximately one-twentieth the mass of the liquid to be atomized at full capacity. In such a case, the gas/liquid mass (for air and water) is about 11.187 pounds per cubic ft. at the nozzle inlet. These prior art higher pressure atomizers waste substantial amounts of the energy in the atomizing gas through the limitations of the dynamics of compressible flow as it mixes with the liquid component. The relatively low gas pressure required by the atomizer of the present invention combined with higher gas volume can be obtained from lower cost and more efficient compressors or blowers, even though it uses relatively higher gas volumes, thereby significantly reducing the operating cost of the atomizer.

Figure 2:
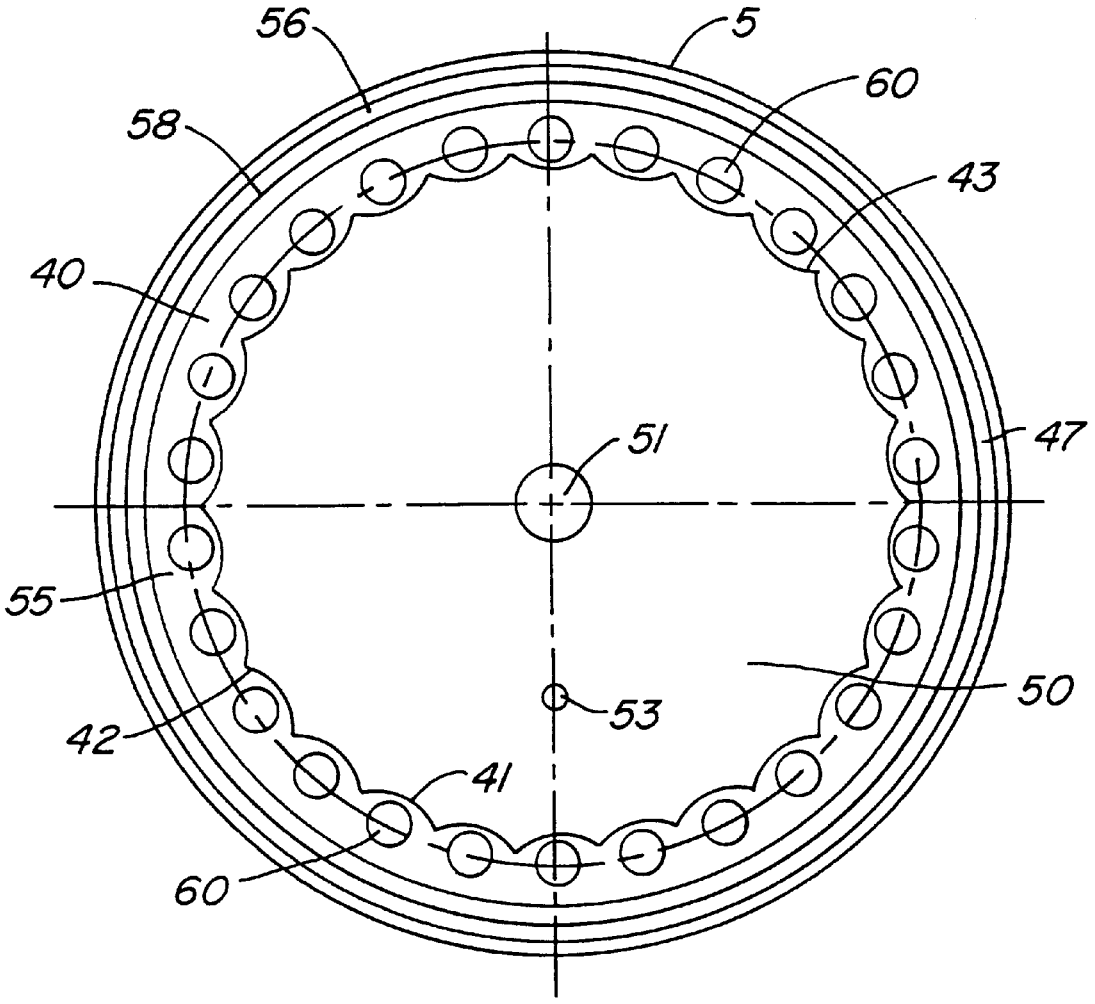
FIG. 2 is a cross-sectional view taken along lines A—A of FIG. 1.
Figure 3:
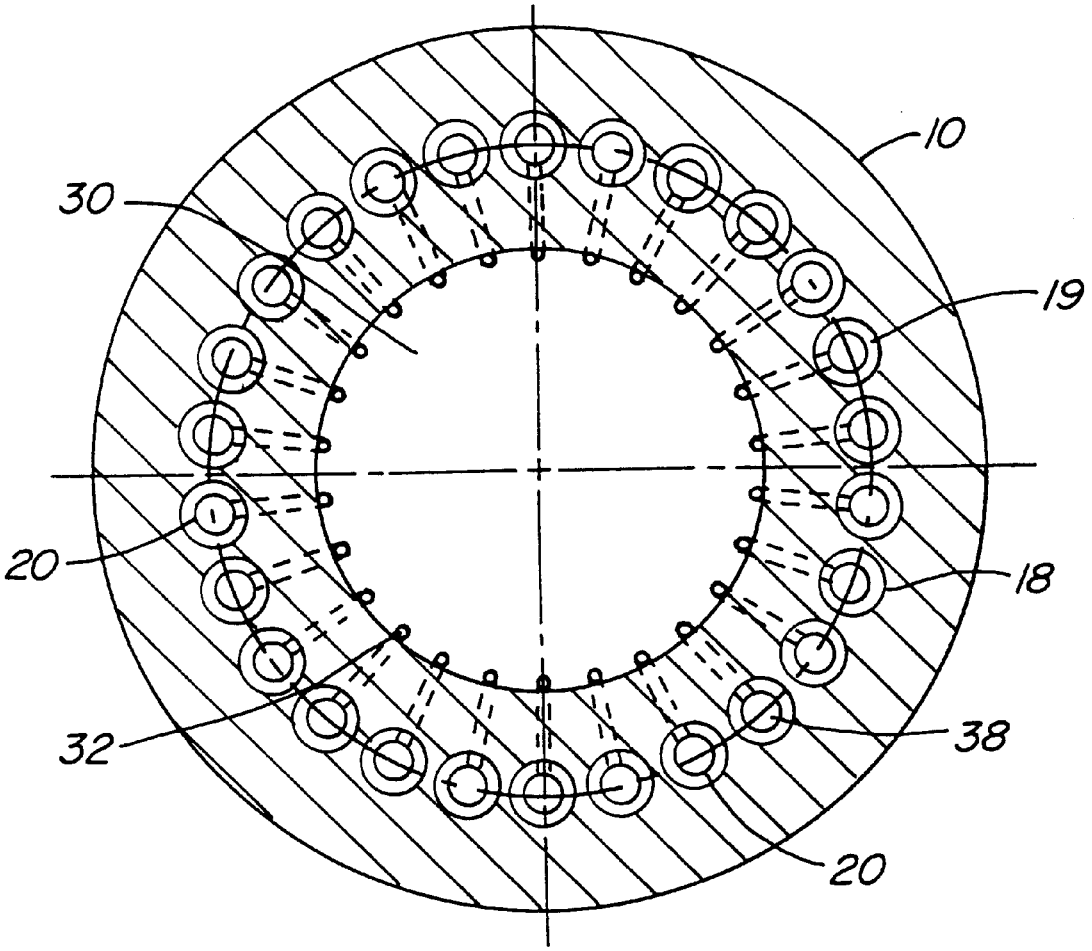
FIG. 3 is a cross-sectional view taken along lines B—B of FIG. 1.
Figure 4:
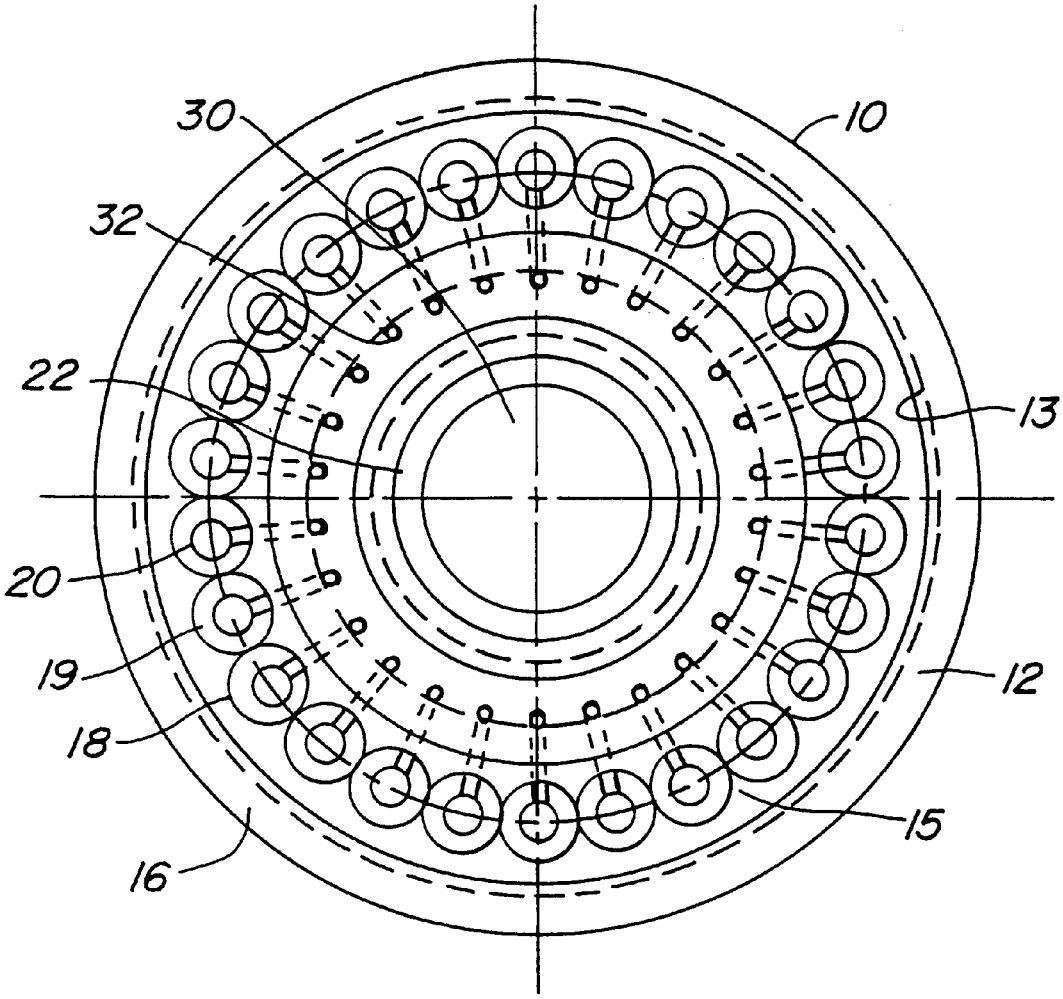
FIG. 4 is a back end view of the low pressure dual fluid atomizer.

From mixing tube 38, the gas/liquid mixture enters and starts to expand in an atomizing chamber 40. The atomizing chamber 40 is a ring or annulus that communicates with and interconnects all mixing tubes 38 where the gas flows from the tubes intermingle. The atomizing chamber has an inner wall 41 which has a diameter which is approximately 0.080 inches smaller than the diameter of a circle which is tangent to an inside wall 39 of the mixing tube 38. The inner wall 41 can be smooth (not shown) or it can be a scalloped wall 42 as shown in FIG. 2. Each scalloped cut 43 of wall 42 is co-located with a mixing tube 38.

The front face 11 of atomizer body 10 has a pin 14 which projects from its center. An atomizer face plate 50 has a centerline hole 51 that fits over pin 14. The face plate 50 and the front face 11 also have holes in their mating surface where a locating pin 53 is installed. The face plate 50 is permanently fastened to the atomizer body 10 front face 11 by a weld 54.

The face plate 50 forms an inner wall 41 and an impact surface 55 of atomizing chamber 40. Opposite the atomizing chamber from each mixing tube 38, and on the same pitch circle as the mixing tube, is a resonator cavity 60. Optimal results are obtained when the distance from outlet 37 of the mixing tube to the inlet 61 to the resonator cavity 60 is between about 0.75 to about 1.25 times the diameter of the mixing tube; the diameter of the resonator cavity 60 is equal to the diameter of the mixing tube; and the depth of the resonator cavity is about 0.75 to about 1.25 times the diameter of the mixing tube.

The periphery of atomizing chamber 40 is open and in fluid communication with an atomizer exit slot or gap 65 that is circumferentially coextensive with the chamber. Exit slot 65 is located between opposing walls each of which has several, serially arranged, opposing shear steps 45 that project into the slot. The front face 11 of the atomizer body 10 and a back side 52 of face plate 50 form the walls bordering the exit slot. The shear steps 45, 56 each have a displacement 46 parallel to the atomizer body 10 centerline and a displacement 47 perpendicular to the atomizer body 10 centerline. The ratio between the displacement 46 parallel to the centerline and the displacement 47 perpendicular to the centerline establishes the spray angle of the atomized liquid leaving atomizer body 10. The low pressure dual fluid atomizer is capable of providing atomized liquid with an included spray angle of between about 30° to about 180°.

In use, the gas/liquid mixture exits from the mixing tube 38 and enters the atomizing chamber 40. As the gas/liquid mixture enters the atomizing chamber 40, a portion of the flow expands and flows towards impact surface 55. The remaining gas/liquid mixture enters the resonator cavity 60 and proceeds to the back end 62 thereof where it is reflected back against the incoming flow. The reflected gas/liquid mixture creates an intense shearing effect which breaks up the surface tension of the liquid and causes further atomization, especially of the larger liquid droplets in the mixture. The arrows 48 in FIG. 6 show the flow pattern in the atomizing chamber 40. The original mixture flow from the mixing tube, the reflected mixture from the resonant cavity, and the mixture flowing off impact surface 55 generate intense turbulence in the atomizing chamber which causes further atomization of the droplets in the mixture before it enters exit slot 65.

In exit slot 65, the gas/liquid streams pass over shear steps 45, 56 where the sharp step edges 58 continue to further break down the surface tension of the liquid at the boundary layer, thereby further reducing and homogenizing the particle or droplet size of the atomized liquid.

There are several alternative embodiments of the low pressure dual fluid atomizer adapted for specific applications. In the embodiment discussed above, the atomized liquid exits from the exit slot in an even and symmetrical pattern. Due to the design of the process vessel in which the atomizer is used or limitation on the atomizer mounting system, non-symmetrical spray patterns for the atomized liquid are at times needed. This can be achieved in several ways. In one approach, the diameter of the liquid supply ports 32 is changed, or dual liquid supply ports are used to feed the liquid into the mixing tubes in specified sectors of the atomizer body 10. This can be employed to increase or decrease the atomized liquid flow in one or more specific sectors of the spray pattern.

Another approach to alter the atomizer spray pattern is to block off one or more sectors of the atomizer body 10. In such a case, the acceleration tubes 19 and the respective liquid supply ports 32 over the corresponding sector of the nozzle are eliminated so that atomized liquid flows from only the portion of the exit slot 65 where the acceleration tubes 19 and the liquid supply ports 32 remain.

In another embodiment, selected liquid supply ports 32 which are connected to the mixing tube 38 can be eliminated so that the atomizing gas from these mixing tubes enters resonator cavity 60 without first mixing with the liquid. This can be used to provide discontinuities in the atomizer spray pattern, which is desirable for some combustion applications. This embodiment can improve atomization at the boundary of spray sectors, a feature which is desirable for some applications.

Figure 7:
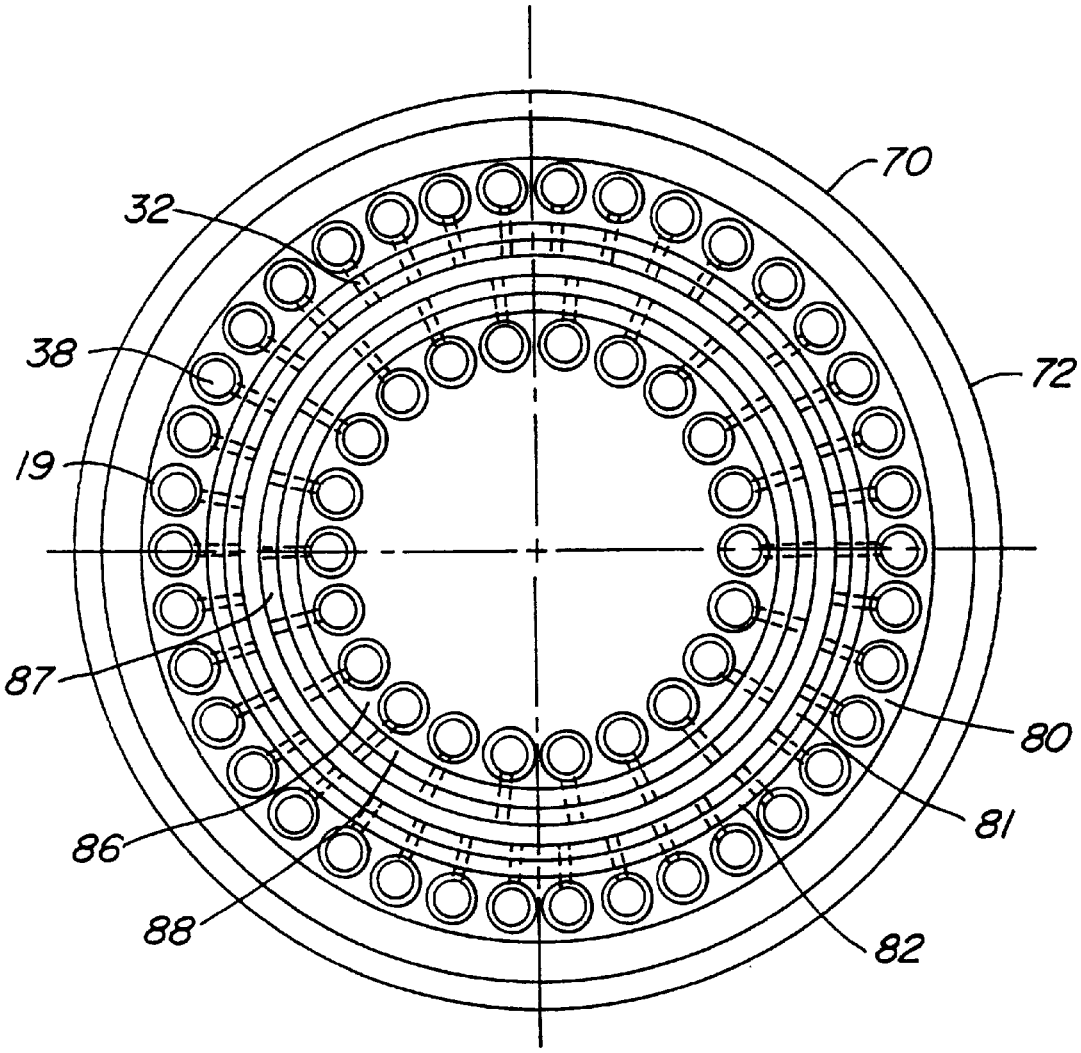
FIG. 7 is a back end view of the high capacity dual fluid atomizer.

In one industrial application, the atomizer 5 shown in FIGS. 1–4 is dimensioned for a maximum liquid flow capacity of about 30 GPM. To increase the capacity of this atomizer above 30 GPM, one or more additional exit slots 65 can be provided. Each has its own respective gas acceleration tubes 19, liquid supply ports 32, mixing tubes 38 and atomizing chambers 40 as is shown in FIGS. 5–7. In the case of the higher capacity atomizer 70 shown in FIG. 5, there are two exit slots 65 which are axially displaced from each other along the centerline of the atomizer. The higher capacity atomizer 70 has an outer gas supply tube 73 with an external thread that engages the threads 13 on the inside surface 17 of a high capacity atomizer body 72. Concentric to and inside the gas supply tube 73 is an outer liquid supply tube 77 which has a sliding fit against the inside wall 81 of the outer concentric gas supply chamber 80. A liquid-tight seal is maintained between the outer concentric gas supply and the liquid by the force pushing the outer liquid supply tube 77 against the seating surface 82. The high capacity atomizer 70 has a second gas supply system which is inside and concentric to the liquid supply system. An inner liquid supply tube 85 has a sliding fit against an outside wall 87 of the inner concentric gas supply chamber 86. A liquid-tight seal is maintained between the inner concentric gas supply and the liquid by the force pushing the inner liquid supply tube 85 against the seating surface 88.

As shown in FIG. 6, atomizing air from outer concentric gas supply chamber 80 and inner concentric gas supply chamber 86 enters a number of gas acceleration tubes 19 where its velocity is increased prior to entering mixing tube 38. At the same time, liquid enters from the back of atomizer body 72 between the outer liquid supply tube 77 and the inner liquid supply tube 85 where it enters the concentric liquid supply cavity 90. The liquid supply cavity 90 provides the atomizing liquid to the mixing tubes 38 through the liquid supply ports 32 at each mixing tube location.

In order to maintain the integrity of atomizer body 72, the resonator cavities 60, which match the location of the respective mixing tubes, are drilled into an outer resonator ring 93 and an inner resonator ring 97. The outer resonator ring 93 is welded to the atomizer body with a weld 94 and contains the shear steps 56 for exit slot 65. The inner resonator ring 97 is welded to the high capacity atomizer body with a weld 95 and contains the shear steps 56 for its exit slot 65.

High capacity atomizer 70 functions the same way as the dual fluid atomizer. It operates at the same gas and liquid pressures except that the increase in the overall number of mixing tubes 38 enables it to achieve higher atomized fluid flow rates.

Figure 8:
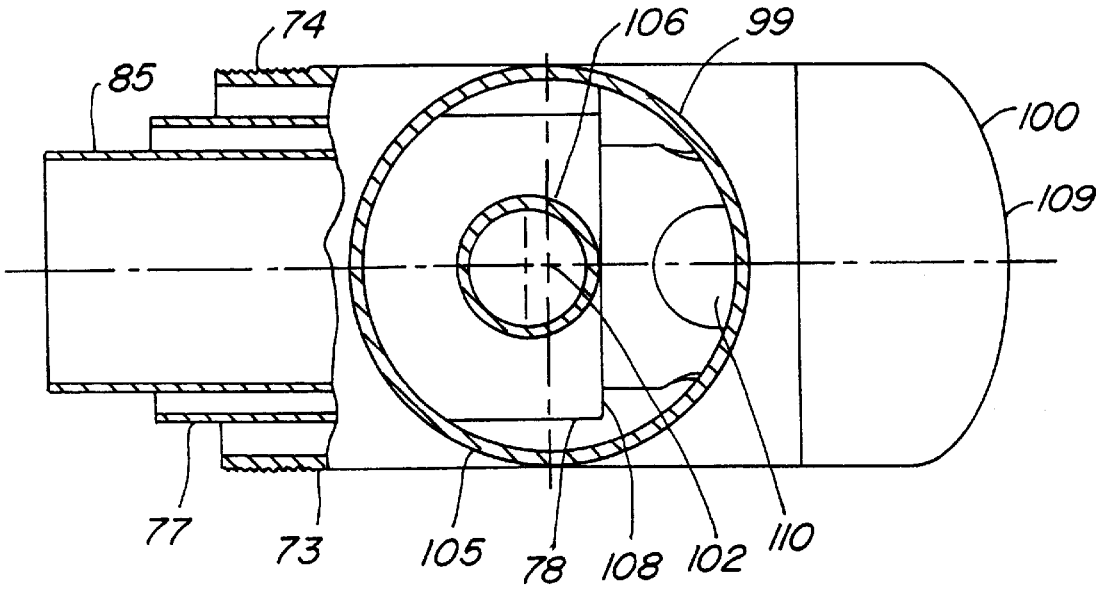
FIG. 8 is a plan view of the atomizer lance 90° end fitting with the atomizing gas crossover feature.
Figure 9:
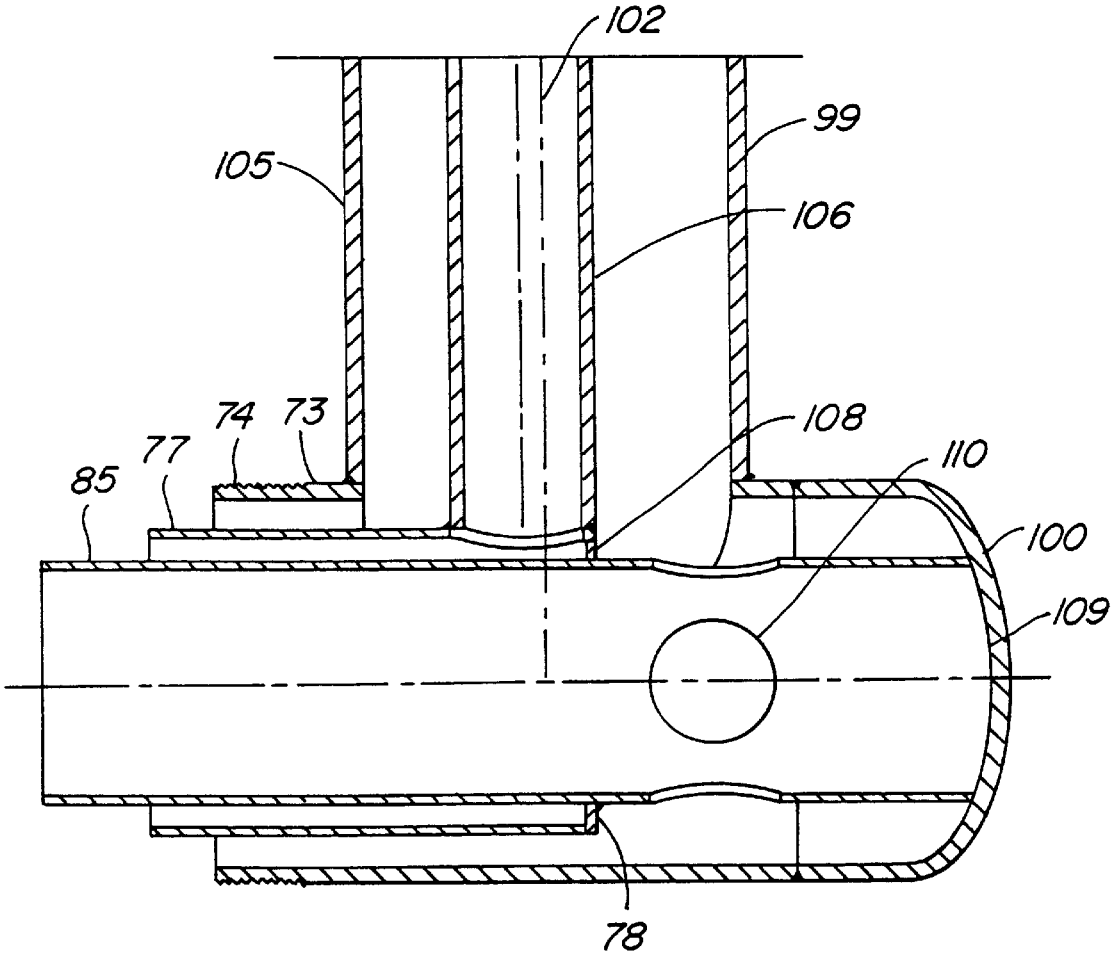
FIG. 9 is a horizontal cross-section of the atomizer lance 90° end fitting with the atomizer gas crossover feature.

In most applications, the coaxial gas supply tube and the liquid supply tube are straight as they enter their respective locations on the back of the atomizer body 10. This is also true of the high capacity atomizer 70. However, some applications require that the coaxial supply tubes, which also mount the atomizer in its operative position, prescribe an angle upstream of the atomizer to properly orient the liquid spray in a vessel, for example. Referring now to FIGS. 8 and 9, an atomizer tip 100 (on which the atomizer (not shown in FIGS. 8 and 9) is mounted) can have an angle to a lance centerline 102 of from 10° to 90°.

The angled atomizer tip 100 is configured so that a single atomizing air supply source in the atomizer lance 99 can allow a portion of the atomizing air to cross over to the inside of the liquid supply from the atomizer lance 99. The atomizer lance 99 has an outer tube 105 which is welded to the outer gas supply tube 73 of the atomizer lance tip 100. Inside the lance outer tube 105 is a liquid supply tube 106 which in turn is welded to the outer liquid supply tube 77. The outer liquid supply tube 77 is joined to the inner liquid tube by a seal ring 108 which forms a liquid-tight boundary on the back side 78 of the outer liquid supply tube 77. The inner liquid supply tube 85 extends through the seal ring and is welded to the back cap 109 of the lance tip 100. The back cap 109 is also welded to the outer gas supply tube 73 to complete the assembly. There are four gas holes 110 located in the inner liquid supply tube 85 which are 90° apart that are designed to take a portion of the atomizing gas and divert it to the inner concentric gas supply chamber 86 of the high capacity atomizer 70.

The dual fluid atomizer 5 described in the two embodiments is very efficient to operate because of the low pressure of the atomizing gas. The normal operating mode for these atomizers is to fix the atomizing gas volume and pressure and modulate the liquid flow rate by adjusting the liquid pressure. Tests on the dual fluid atomizer have demonstrated that it can achieve a liquid flow rate turndown from high capacity to low capacity of 50:1, which is exceptional and cannot be attained with prior art atomizers, which typically have a turndown ratio of no more than 8:1.

The low pressure dual fluid atomizer 5 is normally fabricated from stainless steel. The atomizer body 10 and face plate 5 in the case of the standard nozzle or the high capacity atomizer body 72, outer resonator ring 93 and the inner resonator ring 97 in the case of the high capacity atomizer 70 are each made from the same materials. If the low pressure dual fluid atomizer is used in a chemical process where the atomizer made of stainless steel would be subject to corrosion, then the dual fluid atomizer 5 can be fabricated out of monel. Even though the gas and liquid passages in the dual fluid atomizer 5 are designed to minimize abrasion, there are situations where a solid which is suspended in the liquid can increase dual fluid atomizer 5 wear so the dual fluid atomizer can be fabricated out of hastalloy. In an abrasive and chemically active environment, the dual fluid atomizer 5 can be fabricated from a machinable ceramic. This will give the dual fluid atomizer an indefinite service life.

What is claimed is:

1. An atomizer for atomizing a liquid comprising a housing including a gas chamber adapted to be connected to a supply of gas and a liquid chamber adapted to be connected to a source of liquid; an acceleration tube extending from the gas chamber in a downstream direction and terminating at an outlet; a liquid conduit fluidly connecting the liquid chamber with the acceleration tube so that liquid from the conduit can be entrained in gas flowing through the acceleration tube for discharging a flow of gas/liquid mixture through the outlet; and an exit gap in fluid communication with the outlet for directing the mixture to an exterior of the housing, the exit gap including a plurality of successive shear steps arranged in a flow direction of the mixture through the gap; whereby the liquid becomes partially atomized when entrained in the gas flow and becomes fully atomized upon contacting the shear steps prior to a discharge of the mixture from the exit gap.

2. An atomizer according to claim 1 wherein the acceleration tube includes a tapered section converging in a downstream direction from the gas chamber to a point upstream of where the liquid conduit communicates with the acceleration tube so that the liquid is entrained in the gas stream at a location where the gas stream flows through the acceleration tube at maximum speed.

3. An atomizer according to claim 1 including an atomizing chamber generating turbulence in the mixture flow between the outlet and the exit gap for further atomizing the liquid entrained in the mixture.

4. An atomizer according to claim 3 including a resonant cavity in the housing located on a side of the atomizing chamber opposite the outlet, the resonant cavity having an open end communicating with the atomizing chamber and in substantial alignment with the outlet.

5. An atomizer according to claim 4 wherein the exit gap extends from the atomizing chamber non-parallel to the acceleration tube.

6. An atomizer according to claim 1 including like pluralities of side-by-side, spaced-apart acceleration tubes and associated liquid conduits.

7. An atomizer according to claim 6 including an atomizing chamber in fluid communication with the outlets of the acceleration tubes for intermingling the gas/liquid mixture flows from the acceleration tubes; and wherein the exit gap is in fluid communication with the atomizing chamber for discharging the intermingled mixture flows to the exterior of the housing.

8. An atomizer according to claim 7 wherein the exit gap is defined by opposing, spaced-apart housing walls, and wherein the shear steps are formed on the housing walls.

9. An atomizer according to claim 8 wherein the housing has a longitudinal axis, and wherein the exit gap extends over at least a portion of an arc about the housing axis.

10. An atomizer according to claim 9 wherein the exit gap extends over an arc of at least about 90°.

11. An atomizer according to claim 10 wherein the exit gap extends over an arc of 360°.

12. An atomizer according to claim 9 including a multiplicity of acceleration tubes substantially evenly distributed over the arc of the exit gap.

13. An atomizer according to claim 8 including a resonant cavity for each acceleration tube, each resonant cavity being located in substantial alignment with the corresponding acceleration tube outlet on the side of the atomizing chamber opposite the outlet.

14. An atomizer according to claim 13 wherein a distance between the resonant cavity and the associated acceleration tube outlet is in the range of about 0.75 to about 1.25 times a diameter of the acceleration tube.

15. An atomizer according to claim 13 wherein each cavity has a depth in the range of between about 0.75 to about 1.25 the diameter of the acceleration tube.

16. An atomizer according to claim 13 wherein each resonant cavity has a depth substantially equal to a diameter of the associated acceleration tube.

17. An atomizer for atomizing a liquid comprising a housing having a longitudinal axis, a liquid chamber substantially aligned with the axis and an annular gas chamber substantially concentrically positioned relative to the liquid chamber; a plurality of gas acceleration tubes each extending in a downstream direction from the gas chamber to an outlet end of the tube and including an upstream section extending from the gas chamber and converging towards the outlet, and a downstream section fluidly coupled to the upstream section, ending in an acceleration tube outlet and having substantially the smallest diameter of the acceleration tube; an annular atomizing chamber in fluid communication with all outlets of the acceleration tubes; a resonant cavity for each outlet, each resonant cavity being in substantial alignment with an associated acceleration tube outlet and located on a side of the atomizing chamber opposite the associated outlet; a continuous, arcuate exit gap in fluid communication with the atomizing chamber and extending to an outside of the housing, the exit gap being defined by opposing walls of the housing which include a plurality of successive, spaced-apart shear steps facing the gap; and a liquid conduit for each acceleration tube extending obliquely with respect to the acceleration tube from the liquid chamber to the downstream section of the tube; whereby liquid from the liquid chamber is entrained in and partially atomized in the gas flow to the acceleration tubes to thereby form a gas/liquid mixture which is further atomized in the atomizing chamber as a result of turbulence therein, and which is still further atomized as the mixture flows from the atomizing chamber through the exit gap as a result of contacts with the shear steps.

18. An atomizer according to claim 17 wherein the exit gap extends over an arc relative to the axis of the housing of at least about 90°.

19. An atomizer according to claim 17 wherein at least one of the housing walls defining the exit gap is scalloped in a circumferential direction.

20. An atomizer according to claim 17 wherein the liquid chamber is an annular chamber disposed concentrically about the housing axis; wherein the gap, the chamber, the acceleration tubes, the atomizing chamber, the resonant cavities, and the exit gap, including the shear steps, form a first liquid atomization set; and wherein the housing includes a second atomization set comprising the same elements as the first atomization set, including a second gas chamber concentrically positioned relative to the liquid chamber in fluid communication with the liquid chamber to thereby double the liquid atomization capacity of the atomizer.

21. An atomizer according to claim 20 including a mounting set for supporting the atomizer and flowing the fluid and the gas from respective sources at least partially non-parallel to the gas chamber and the fluid chamber.

22. An atomizer according to claim 17 wherein the exit gap is oriented non-parallel to the housing axis.

23. A method for atomizing a liquid flowing at a variable rate comprising the steps of forming a plurality of subsonic, separate gas streams having a substantially constant subsonic flow rate and a substantially constant pressure; entraining a liquid in each gas stream to form a gas/liquid mixture in which the liquid is only partially atomized; turbulently intermingling the separate gas streams in an atomizing chamber to thereby further atomize the liquid; directing the mixture from the atomizing chamber to an exterior of the atomizer by contacting the mixture with a plurality of serially arranged shear steps as it flows from the atomizing chamber to the exterior to thereby fully atomize the liquid prior to the discharge of the mixture from the atomizer; and modulating the rate at which the liquid is entrained in the gas streams while maintaining the gas stream flow rate and the gas pressure substantially constant to thereby correspondingly modulate the rate at which atomized liquid is discharged to the exterior.

24. A method according to claim 23 including supplying gas for the gas streams at a pressure in a range of between about 12 PSIG to about 25 PSIG.

25. A method according to claim 24 including supplying the gas at a pressure in the range between about 20 PSIG to about 25 PSIG.

26. A method according to claim 24 including supplying liquid for the entraining step at a pressure of more than about 25 PSIG.

27. A method according to claim 26 including supplying the liquid at a pressure in the range of between about 50 PSIG to about 100 PSIG.

28. A method according to claim 23 wherein the step of modulating comprises the step of modulating the pressure of the liquid being entrained in each gas stream over a range of between about 50 PSIG to about 100 PSIG.

29. A method according to claim 23 wherein the step of directing the mixture flow to the exterior of the atomizer comprises diverting the mixture to flow from the atomizing chamber in a direction non-parallel to the direction of the subsonic gas streams.

30. A method according to claim 23 wherein the step of modulating comprises varying the rate at which the liquid is entrained in the gas streams over a range of more than about 10:1.

31. A method according to claim 30 wherein the step of modulating comprises varying the rate at which the liquid is entrained in the gas streams over a range of at least about 25:1.

32. A method according to claim 31 wherein the step of modulating comprises varying the rate at which liquid is entrained in the gas streams over a range of at least about 50:1.

33. A method according to claim 23 wherein the entraining step includes controlling the respective liquid and gas streams so that the mixture has a mass of no more than about 3 lbs/cuft.

34. A method according to claim 33 including controlling the respective liquid and gas streams so that the mixture has a mass of no more than about 1.11 lbs/cuft.

* * * * *